US010987532B2

(12) United States Patent
Lawton

(10) Patent No.: US 10,987,532 B2
(45) Date of Patent: Apr. 27, 2021

(54) BODY COACH

(71) Applicant: Tafari Lawton, River Edge, NJ (US)

(72) Inventor: Tafari Lawton, River Edge, NJ (US)

( * ) Notice: Subject to any disclaimer, the term of this patent is extended or adjusted under 35 U.S.C. 154(b) by 0 days.

(21) Appl. No.: 16/583,015

(22) Filed: Sep. 25, 2019

(65) Prior Publication Data

US 2020/0101342 A1 Apr. 2, 2020

Related U.S. Application Data

(60) Provisional application No. 62/737,423, filed on Sep. 27, 2018.

(51) Int. Cl.
*A63B 1/00* (2006.01)
*A63B 23/12* (2006.01)
(Continued)

(52) U.S. Cl.
CPC ..... *A63B 1/00* (2013.01); *A63B 21/0414* (2013.01); *A63B 21/0552* (2013.01);
(Continued)

(58) Field of Classification Search
CPC . A63B 1/00; A63B 23/1218; A63B 23/03525; A63B 23/04; A63B 23/03575; A63B 23/1227; A63B 21/0552; A63B 21/0414; A63B 21/072; A63B 21/078; A63B 21/0557; A63B 21/4033; A63B 21/00181; A63B 21/00047; A63B 21/02; A63B 21/05; A63B 21/055; A63B 21/0555; A63B 2209/08; A63B 2225/093; A63B 2225/10; A63B 71/023; A63B 71/0036; A63B 2071/025; A63B 2210/50;
(Continued)

(56) References Cited

U.S. PATENT DOCUMENTS 4,241,914 A * 12/1980 Bushnell ..... A63B 1/00 482/130
4,696,470 A * 9/1987 Fenner ..... A63B 1/00 182/153

(Continued)

FOREIGN PATENT DOCUMENTS

WO WO 2009/109793 A1 11/2009

*Primary Examiner* — Megan Anderson
*Assistant Examiner* — Kathleen Vermillera
(74) *Attorney, Agent, or Firm* — Davis IP LLC; Benjamin Davis

(57) ABSTRACT

The present invention generally concerns an exercise frame. More specifically, a frame, named the Body Coach, includes a base with both wheeled and un-wheeled stabilizers, two pivoting posts, and extending slats having dip handles and pullup bar holders. The frame is small and mimics heights normal to larger caged stations in gyms, which provide a greater natural resistance for calisthenics. Retractable slats, telescopically housed in each post, extend a pullup bar upward at heights up to 7.00'. An A/R band rests in a space between the two posts. Both the band's tautness and its vertical placement within the space, relative to the extended height of the pullup bar, are adjustable. Each post pivots downward for easy storage, but, in use, the frame is sturdy, centered, and reconfigures to a user's specific height and range of motion for unmanned assistance or resistance training.

7 Claims, 11 Drawing Sheets

(51) Int. Cl.

| | |
|---|---|
| ***A63B 21/055*** | (2006.01) |
| ***A63B 21/04*** | (2006.01) |
| ***A63B 23/04*** | (2006.01) |
| ***A63B 21/072*** | (2006.01) |
| ***A63B 23/035*** | (2006.01) |
| ***A63B 21/078*** | (2006.01) |

(52) U.S. Cl.
CPC ..... *A63B 21/072* (2013.01); *A63B 21/078* (2013.01); *A63B 23/03525* (2013.01); *A63B 23/03575* (2013.01); *A63B 23/04* (2013.01); *A63B 23/1218* (2013.01); *A63B 2209/08* (2013.01); *A63B 2225/093* (2013.01)

(58) Field of Classification Search
CPC .. A63B 3/00; A63B 9/00; A63B 17/00; A63B 17/04; A63B 2208/0285
See application file for complete search history.

(56) References Cited

U.S. PATENT DOCUMENTS

| | | | | |
|---|---|---|---|---|
| 4,921,245 | A * | 5/1990 | Roberts | A63B 7/02 482/23 |
| 5,527,242 | A | 6/1996 | Gangloff | |
| 5,662,556 | A | 9/1997 | Gangloff | |
| 6,322,482 | B1 * | 11/2001 | Kim | A63B 21/0004 482/121 |
| 7,717,837 | B2 * | 5/2010 | Florczak | A63B 21/4035 482/143 |
| 8,834,327 | B1 * | 9/2014 | George, Jr. | A63B 21/4029 482/96 |
| 8,876,679 | B2 * | 11/2014 | DeMarco | A63B 1/00 482/143 |
| 9,295,871 | B2 * | 3/2016 | Luedeka | A63B 23/0458 |
| 9,895,564 | B1 | 2/2018 | Katz | |
| 10,052,511 | B2 | 8/2018 | Brown | |
| 10,471,293 | B2 * | 11/2019 | George | A63B 23/0405 |
| 2004/0110608 | A1 * | 6/2004 | Washington | A63B 21/0023 482/96 |
| 2005/0003938 | A1 * | 1/2005 | Henderson | A63B 21/068 482/143 |
| 2005/0130817 | A1 * | 6/2005 | Sjuragri | A63B 23/0233 482/142 |
| 2010/0190612 | A1 | 7/2010 | Cook | |
| 2011/0183823 | A1 * | 7/2011 | Priday | A63B 21/0783 482/131 |
| 2012/0231937 | A1 * | 9/2012 | Murphy | A63B 23/1236 482/93 |
| 2013/0178338 | A1 | 7/2013 | Ross | |
| 2018/0221700 | A1 * | 8/2018 | George | A63B 23/0355 |

* cited by examiner

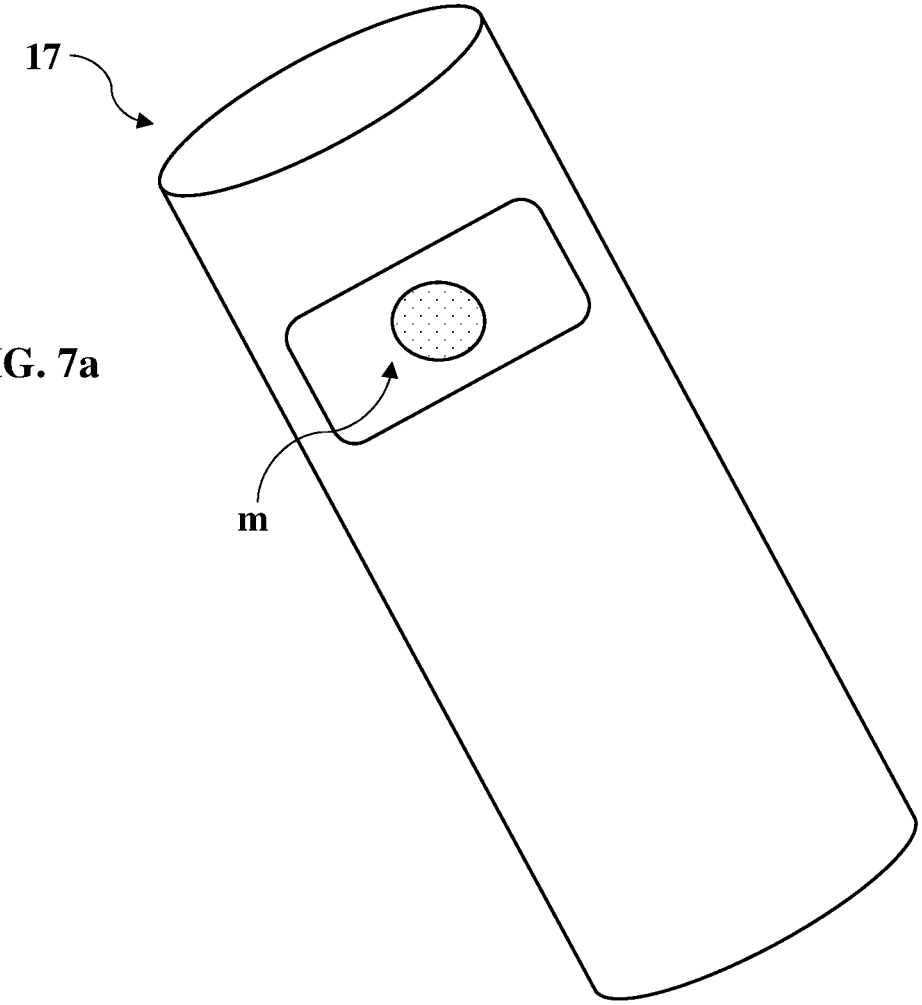
FIG. 7a
FIG. 7b
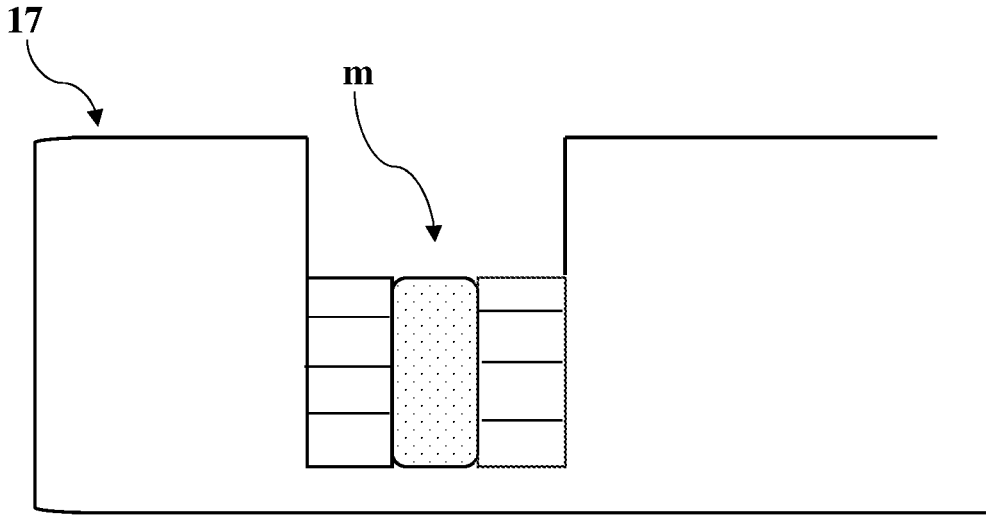

BODY COACH

RELATED APPLICATIONS

This non-provisional patent application claims priority to U.S. Prov. Pat. App. No. 62/737,423 filed on Sep. 27, 2018.

FIELD OF THE INVENTION

The present invention generally concerns an exercise frame. More specifically, a frame, named the Body Coach, includes a base with both wheeled and un-wheeled stabilizers, two pivoting posts, and extending slats having dip handles and pullup bar holders. The frame is small and mimics heights normal to larger caged stations in gyms, which provide a greater natural resistance for calisthenics. Retractable slats, telescopically housed in each post, extend a pullup bar upward at heights up to 7.00'. An A/R band rests in a space between the two posts. Both the band's tautness and its vertical placement within the space, relative to the extended height of the pullup bar, are adjustable. Each post pivots downward for easy storage, but, in use, the frame is sturdy, centered, and reconfigures to a user's specific height and range of motion for unmanned assistance or resistance training.

BACKGROUND OF THE INVENTION

We rarely think of gravity as a practical or useful thing, a beneficial tool, for the body. One mention of gravity and our imaginations run wild with sci-fi tendencies of time travel related to space time curvatures and unknown energies. But, beyond the thought of that, and us flying off into space without a constant pull to the earth's surface, gravity greatly influences human physiology and wellness. This force benefits human health and wellness in ways we take for granted.

Simple calisthenics like, sit ups, pullups, dips, chin-ups, squats, or a simple jog uphill works muscle groups that benefit from nature's resistance. Gravity's downward pull increases muscle mass and bone density. Any time one picks up a weight for strength training, the user benefits from the resistance provided by gravity.

But, each one is different. Some bodies are infirmed. They suffer from trauma that leads to a limited range of motion in the upper body. The natural resistance we feel every day makes simple movements like lifting one's arm very hard. People assigned to physical therapy or rehabilitation suffer from a limited range of motion or lack a good core stability. For less complicated upper body and shoulder rehab, doctors tell patients to do assisted calisthenics like those listed above.

Pullups, chin ups, and dips engage the back and shoulders to improve strength about the chest, pectorals, lats, rhomboids, and trapezius muscles. Beginners often perform easier versions of the exercises building up to unassisted calisthenics. Hanging from a low-lying bar, while one's feet touches the ground for several seconds, works the upper shoulder blades. Slanting one's body under a bar, with extension of the feet, in an inverted row fashion, can work the chest and shoulders. With palms facing in, one sitting under a bar can do assisted chin-ups to work their biceps.

For assisted pullups and chin-ups, resistance bands are often slip knotted to pullup bars that are 6.00' to 7.00' high on large exercise frames. A riser is used as a step ladder to allow the user to grab the elevated bar. The user places their foot in the open portion of the band and begins the pullup motion. Resistance bands are typically color coded to give an indication of its elasticity and load bearing capabilities. Bands made of less material give less resistance and, therefore, less assistance, where the user is made to shoulder most of their body weight during the exercise. Even in a healthy state, this process can be physically difficult for most people.

My frame, called the Body Coach, helps people unable to perform natural calisthenics on their own. The present invention is small and mimics heights normal to larger caged stations in gyms, which provide a greater natural resistance for calisthenics. The Body Coach allows a user to off load a portion of their weight when their knees are rested across an A/R band at adjustable heights relative to three key vertical stops for an extended pullup bar. The tautness of the band can also be adjusted to provide an extra measure of comfort when using the frame to improve overall core stability and upper body strength. With their knees comfortably supported by the band, a user extends their torso and arms upward to grab the pullup bar or dip handles to perform pullups, chin-ups, or dips even with a limited range of motion.

U.S. Pat. Nos. 5,527,242 and 5,662,556, both to Gangloff, disclose a foldable exercise machine for pullups. Vertical bar supports are connected to a base and the space between the supports accepts a user's torso. While lying on the ground, the user pulls up on the bar, where their chin touches the bar to achieve a limited pullup motion.

U.S. Pat. No. 10,052,511 to Brown discloses a triceps dip stand. Brown's frame includes stabilizing legs that are welded to outer uprights having retractable means to vertically extend handgrips. Horizontal cross members allow lateral movement of each handgrip, and locking pins and apertures are used to fix their vertical and horizontal positions. However, the frame is not wholly collapsible. It cannot be fully disassembled for storage. The welded nature of the frame will not allow pivoting of the outer uprights down to a floor (see Brown at FIG. 1 numerals 74, 80, 82, 84, 86, 88, and 90). Brown's frame lacks the ability for unmanned assistance or resistive training for user's having varied physical range of motion by a weight bearing resistance band.

U.S. Pat. No. 9,925,871 to Luedeka discloses an assisted body weight trainer that is a large steel frame incorporating resistance bands of varying widths across many points. Luedeka uses rubber strength bands that matches the width of his frame, being 41.00" or roughly 3.40' wide. Luedeka calculated how much assistance each width of the band provides. The band can be used for assistance or resistant training. However, the frame is large enough for a person to step inside it, which would make it at least 6.50' to 8.00' tall from a floor.

U.S. Pat. No. 9,895,564 to Katz discloses an adjustable exercise device. Katz gives a pair of upper and lower supports, where both upper supports are permanently connected to a cylindrical bar. The upper supports are telescopically connected to lower supports to allow for minimal vertical adjustment of the cylindrical bar, where one can perform unassisted but modified pullups. The cylindrical bar has holes that accept handgrips, where each handgrip is directly attached to the bar and not the supports. The lower supports are substantial T-shaped, rigid, and are unable to rotate into a downward position. Also note that, Katz's frame stays relatively close to a floor, not reaching the heights of the current invention.

U.S. Pat. App. No. 2013/0178338A, as field by Ross, discloses an extended pullup bar with telescoping tubes.

U.S. Pat. App. No. 2010/0190612A, as filed by Cook, discloses a large exercise frame with a pullup bar that can hold a punching bag.

Int. Pub. No. WO 2009/109793, as field by Becsey, discloses an exercise unit wherein two interconnecting posts are mated to an H-type base and gripping tubes using four non-releasable joints. The H-type base rests on a floor. The interconnected posts may fold down onto the H-type base and the gripping tubes may fold down onto the interconnected posts for storage. The gripping tubes have handles but also have holes to accommodate hinges located about the same. This frame also includes a support brace for the invention when used in a tilted, or inverted, position. The invention lacks a pullup bar that can extend to the heights of the current invention.

None of the above references teach an exercise frame of a personal size that extends a pullup bar upward at heights up to 7.00' to mimic heights normal to larger caged stations in gyms. My frame reconfigures to a user's specific height and range of motion for unmanned assistance or resistance training for pullups, dips, or chin-ups by adjusting an A/R band's tautness and vertical placement relative to the extended height of the pullup bar. The frame's posts pivot downward for easy storage. Therefore, there is a need for the present invention.

SUMMARY OF THE INVENTION

An object of the present invention includes an exercise frame having two posts with retractable slats that extend a weighted pullup bar to heights of 5.50', 6.00', and 7.00' relative to a base's upper surface, to which the posts are hingedly connected. An adjustable A/R band is in a space between the two posts and moves vertically between said posts at heights from 16.00" to 28.00" relative to the base's upper surface. The weighted pullup bar can be positioned at holders on clevis hinge surfaces or at holders located on dip handles.

It is an embodiment of the present invention where the adjustable A/R band moves vertically between said posts at heights from 16.00" to 32.00" relative to the base's upper surface.

It is an embodiment of the present invention for the two posts, at their lower ends, to act as a shaft and yoke for a clevis bracket fixed to the upper surface of the base.

It is an embodiment of the present invention where the pair of posts may each rotate independently in a downward motion onto the base's upper surface and may be locked in said downward position.

It is an embodiment of the present invention for the A/R band to be made from a natural or synthetic latex rubber and can support up to 300 lbs with minimal wear to elasticity.

It is an embodiment of the present invention where the tautness of the A/R band is adjusted by one or more buckles connected to the band.

It is an embodiment of the present invention for the base to rest on four supports that telescopically extend stabilizers therefrom.

It is an embodiment of the present invention where two of the telescopically extended stabilizers have a wheel on their extended end.

It is an embodiment of the present invention for the weighted pullup bar to weigh from 5.00 lbs to 10.00 lbs and have notches near its distal ends, where the center of each notch is tapped and holds a magnet.

It is another embodiment of the present invention where each dip handle is associated with a pullup bar holder having a magnet at its center.

It is another embodiment of the present invention where each clevis bracket is associated with a pullup bar holder having a magnet at its center.

It is an embodiment of the present invention where the holders are tapped to receive magnets at their centers and are sized to mate with the diameter and notches of the weighted pullup bar, such that the magnets located at the distal ends of the pull up bar and the magnets located in the holders align and attract each other.

BRIEF DESCRIPTION OF DRAWINGS

FIG. 7*a* depicts a distal end of the weighted pullup bar 17. There is a notch cut into the cylindrical bar and a hole that is tapped to insert a magnet m.

FIG. 7*b* depicts a cross section of a distal end of the weighted pullup bar 17. It is clearer that the notch is cut into a solid cylindrical bar 17 where a hole has been tapped and filled with a magnet m to mate with other magnets located at either the pullup bar holders or the sit up position holders.

TABLE 1

Figure 1:
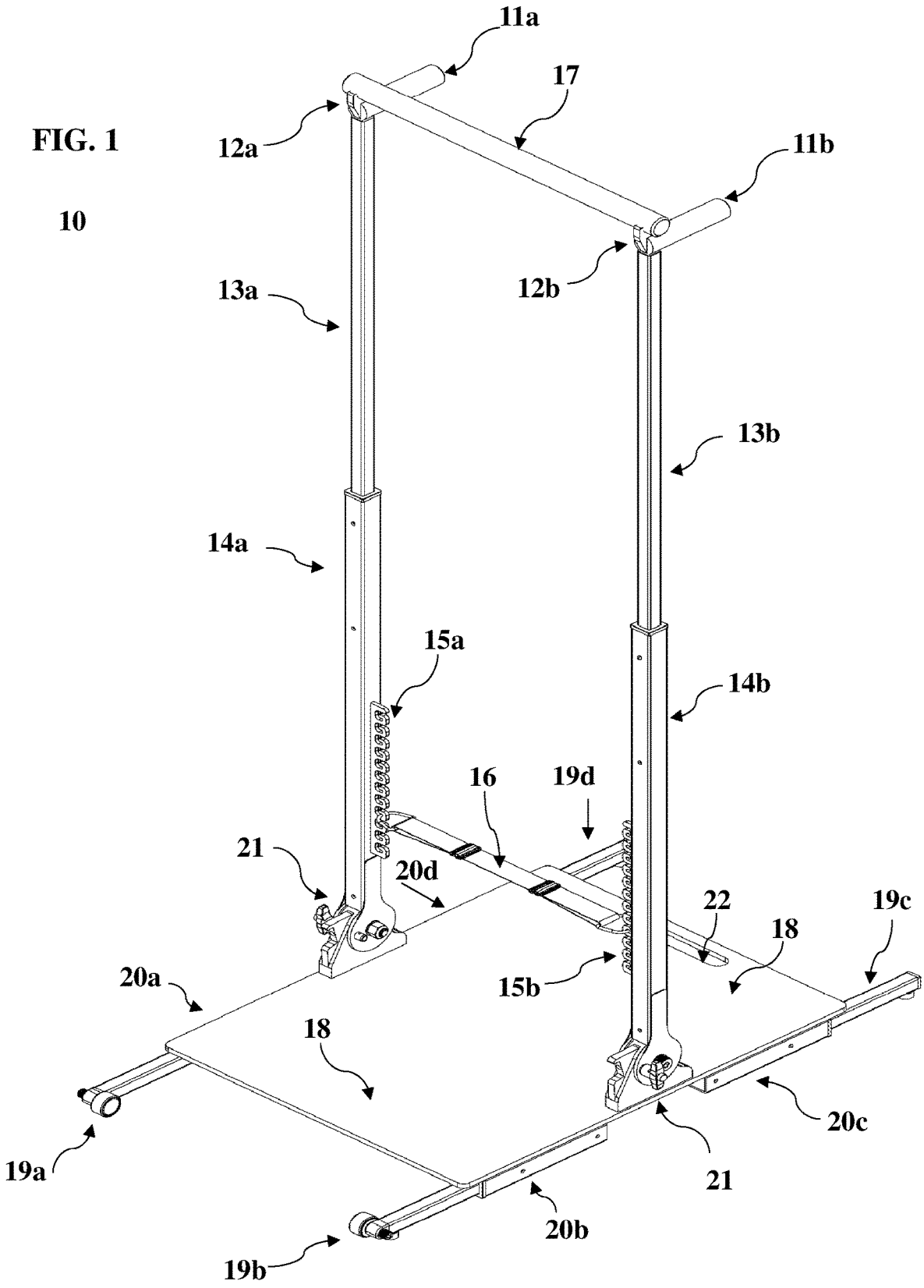
FIG. 1 depicts a full view of the Body Coach 10. The invention includes a base 18 with both wheeled 19*a*, 19*b* and un-wheeled 19*c*, 19*d* stabilizers housed in supports 20*a*-20*d*, two pivoting posts 14*a*, 14*b*, and extending slats 13*a*, 13*b* having dip handles 11*a*, 11*b* and magnetic pullup bar holders 12*a*, 12*b*. Each slat, telescopically housed in the posts, may extend the pullup bar 17 upward at heights up to 7.0'. An A/R band 16 rests in a space between the two posts 14. Both the band's tautness and its vertical placement within the space, relative to the extended height of the pullup bar 17, are adjustable.

| Numerical Designations Used in All Figures<br>Reference Numerals & Letters | |
|---|---|
| 10 | The Body Coach |
| 11 | Dip Handle |
| 11a | Left Dip Handle |
| 11b | Right Dip Handle |
| 12 | Pullup Bar Holder |
| 12a | Left Pullup Bar Holder |
| 12b | Right Pullup Bar Holder |
| 13 | Extending Slat |
| 13a | Left Extending Slat |
| 13b | Right Extending Slat |
| 14 | Pivot Post |
| 14a | Left Pivot Post |
| 14b | Right Pivot Post |
| 15 | Retainer Hooks |
| 15a | Left Retainer Hooks |
| 15b | Right Retainer Hooks |
| 16 | A/R Band |
| 17 | Weighted Pullup Bar |
| 18 | Base |

TABLE 1-continued

| Numerical Designations Used in All Figures<br>Reference Numerals & Letters | |
|---|---|
| 19 | Extending Stabilizer |
| 19a | Front Left Stabilizer with Wheel |
| 19b | Front Right Stabilizer with Wheel |
| 19c | Back Right Stabilizer |
| 19d | Back Left Stabilizer |
| 20 | Support |
| 20a | Front Left Support (not shown) |
| 20b | Front Right Support |
| 20c | Back Right Support |
| 20d | Back Left Support (not shown) |
| 21 | Left & Right Clevis Joint |
| e | Rubber Foot |
| f | Wheel and Threaded Screw |
| g | Clevis Bracket |
| h | Sit Up Position Holder with Magnet |
| i | Custom Yoke |
| j | Quick Lock Pin |
| k | Lock Nut for Clevis Bolt |
| l | Rotation Bolt with Bearings/Flanged Bushing |
| m | Bar Notch with Magnet |
| n | Centered Bore |
| o | Quick Lock Bore Upright Position |
| p | Quick Lock Bore Storage Position |
| q | Sit Up Position Holder |
| r | Magnet in Holder |
| s | Securing Bolt for Clevis Hinge to Base |
| t | Threaded Bore |
| u | Bracket Bottom Surface |
| V | Vertical Extension for Slats |
| w | A/R D-Ring Connector |
| x | Double D-Ring Buckle |
| z | Bearing/Flanged Bushing and Washers |
| aa | Quick Release Connector |
| bb | Flanged Collar |
| cc | Stabilizer End Cap |

DETAILED DESCRIPTION OF THE INVENTION

Figure 1A:
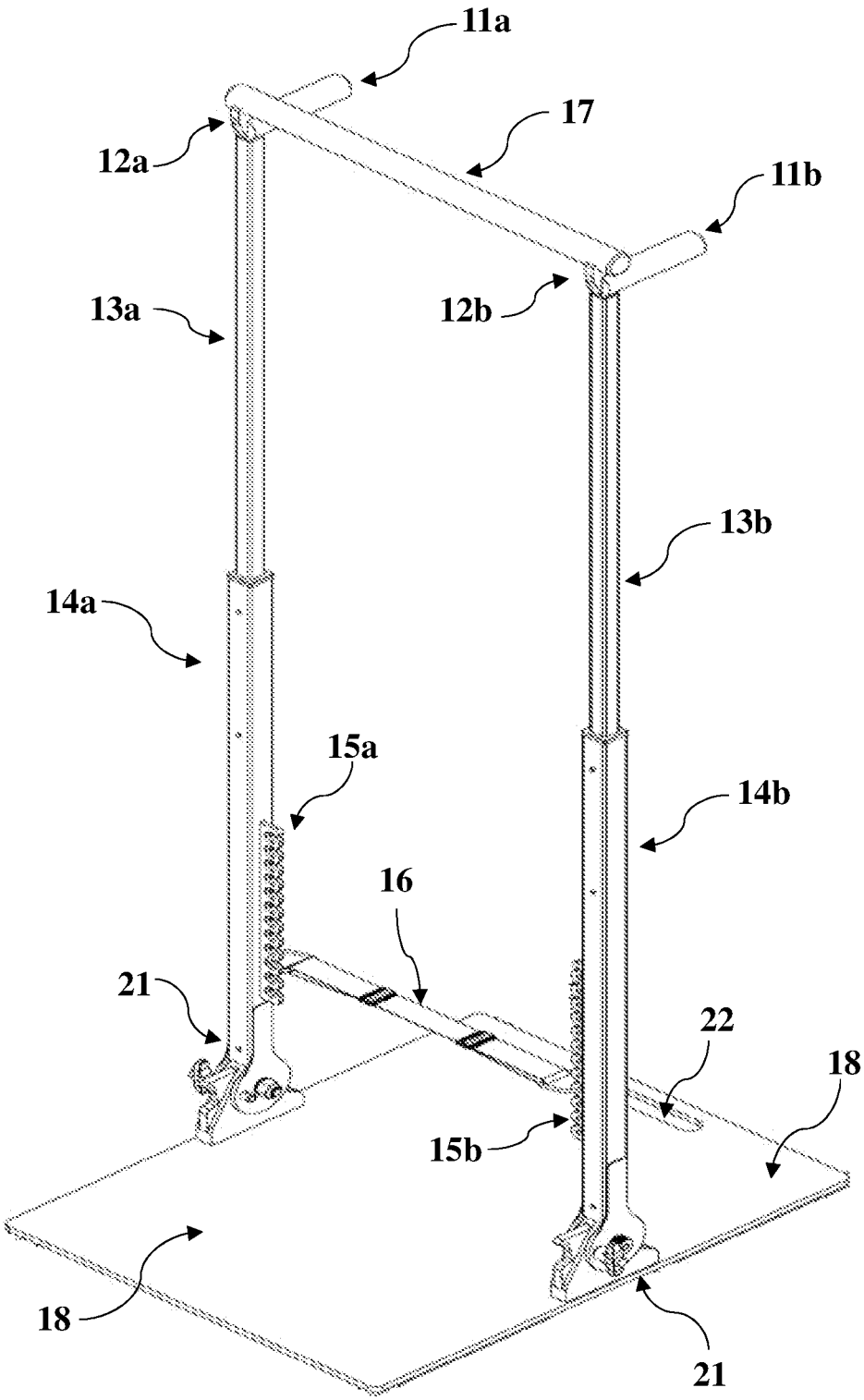
FIG. 1*a* shows a full view of the Body Coach 10 where the base 18 does not include wheeled or un-wheeled stabilizers or supports. In this embodiment, the base's 18 bottom surface rests directly on a floor. All other elements are the same as in FIG. 1.

The following words describe my exercise frame. I made it to help those with a limited range of motion perform calisthenics. The frame is simple to use and is of a personal size for easy storage, but it is not so simple as to lose novelty. From FIG. 1, my invention 10 includes a base 18 with both wheeled 19*a*, 19*b* and un-wheeled stabilizers 19*c*, 19*d*, two pivoting posts 14*a*, 14*b*, and extending slats 13*a*, 13*b* having dip handles 11*a*, 11*b* and magnetic pullup bar holders 12*a*, 12*b*. However, FIG. 1*a* shows a full view of the Body Coach 10 where the base 18 does not include wheeled or un-wheeled stabilizers or supports. In this embodiment, the base's 18 bottom surface rests directly on a floor.

The slats 13*a*, 13*b* are telescopically housed in each post 14*a*, 14*b* and may extend the pullup bar 17 upward at heights up to 7.0'. The frame 10 is small but mimics heights normal to larger caged stations in gyms, where greater heights provide more downward pull during calisthenics (see U.S. Pat. No. 9,925,871 to Luedeka).

An A/R band 16 rests in a space between the two posts 14*a*, 14*b*. Both the band's 16 tautness and its vertical placement within the space, relative to the extended height of the pullup bar 17, are adjustable. The ability to adjust the distance between the variable height pullup bar 17 and the A/R band 16, in addition to varying the band's 16 tautness, gives a user options when using the frame according to their height and range of motion for assisted pullups, chin-ups, or dips, where the A/R band accepts the weight of a user as an offset at their knees. In addition, the frame 10 can be configured for assistance or resistance training for pushups and squats. For pushups, one would assume the pushup position while contacting their chest or hip area across the band for assistance. For squats, one would place themselves in a squatting position and have the A/R band contact their shoulders and perform the traditional squatting exercise.

Figure 6A:
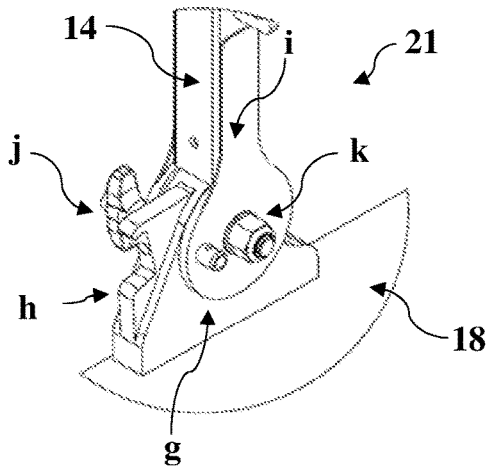
FIG. 6*a* depicts an enhanced view of the clevis hinge 21 as viewed from the space between the two posts 14. The hinge 21 allows each post 14 to pivot downward by 90° onto the base's 18 upper surface. The clevis bracket g is connected to the base 18 and is mated with a custom yoke i, being two ears attached to parallel sides of a post 14. The hinge 21 also includes a Kwik-Lok™ pin j, a sit up position holder h with a magnet for the weighted pullup bar 17 (not shown), and a lock nut k for a clevis bolt.
Figure 6B:
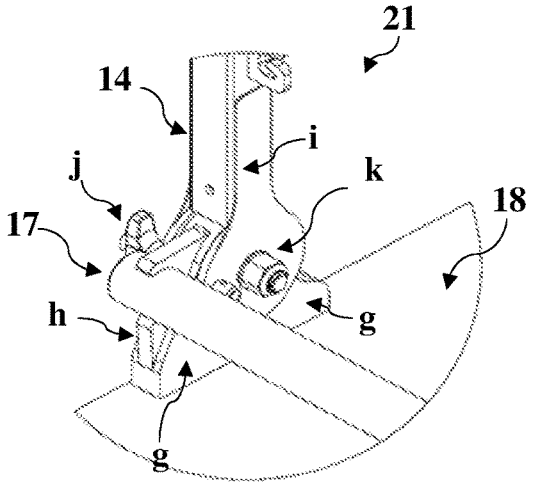
FIG. 6*b* is like FIG. 6*a* but further depicts the sit up position holder h having the weighted pullup bar 17.
Figure 6C:
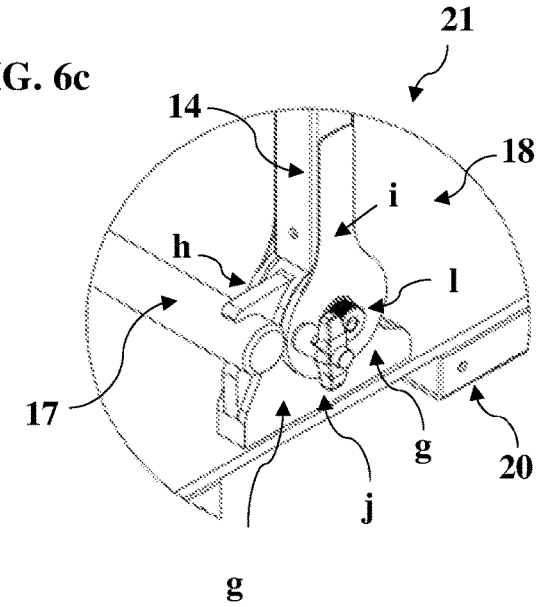
FIG. 6*c* depicts an enhanced view of the clevis hinge 21 as viewed from the outer side of a post 14. This view gives one a better perspective of the Kwik-Lok™ pin j and a rotation bolt with bearings being flanged bushings 1. All other elements are the same.

The pullup bar 17 is a mostly solid cylindrical rod that is weighted and can be attached by friction and magnets to sit up position holders, as detailed in FIGS. 6*a*-6*c*, or attached to pullup position holders 12*a*, 12*b*. The weighted pull bar 17 can be detached from the frame 10 and used on its own as a free weight for weight training other parts of the body.

Figure 5A:
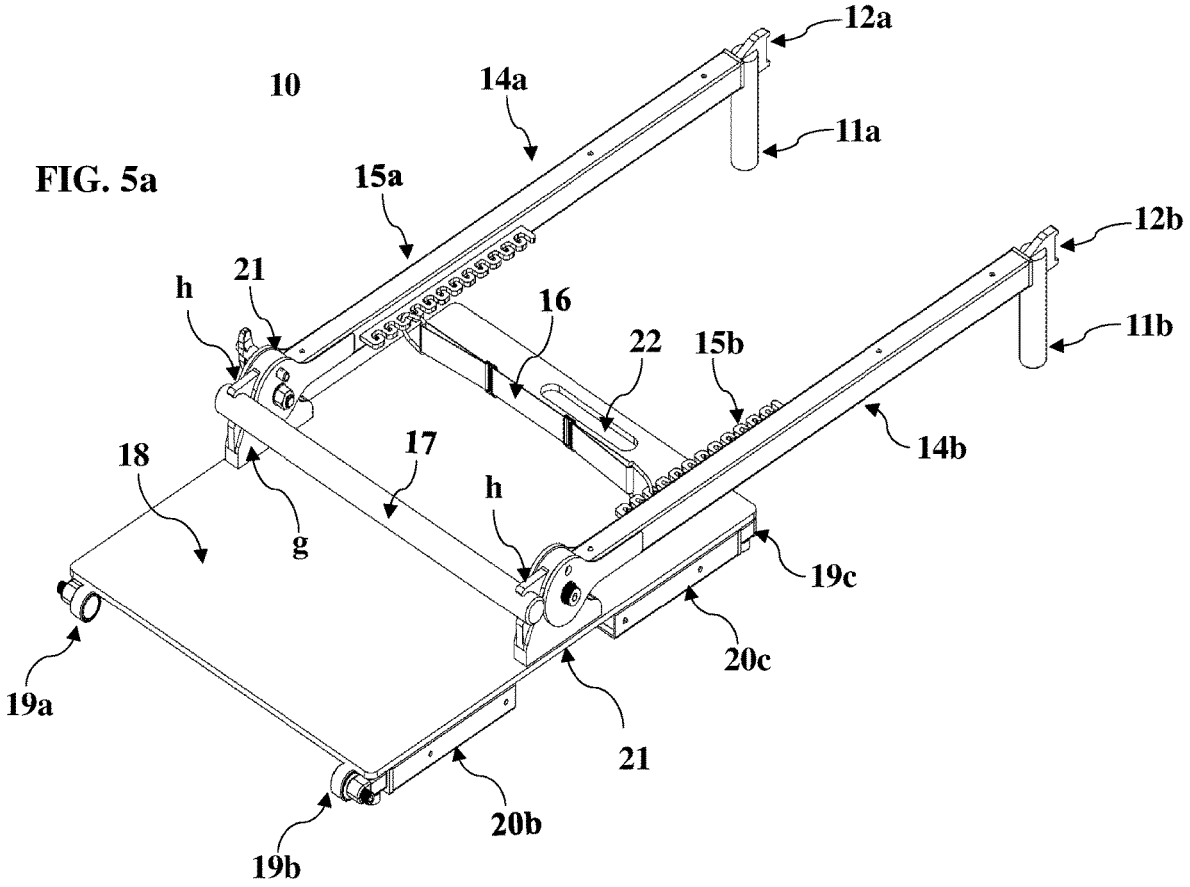
FIG. 5*a* depicts a full view of the Body Coach 10 in a stored position. Each slat 13 is fully retracted into each post 14 and has been rotated downward at each clevis hinge 21 by 90° onto the base's 18 upper surface for easy storage. When folded downward, the dip handles 11*a*, 11*b* are used to lift the frame 10 up at a 45° tilt onto the wheeled stabilizers 19*a*, 19*b*. This allows the frame 10 to roll around for easy transport and storage, like a wheel barrel.
Figure 5B:
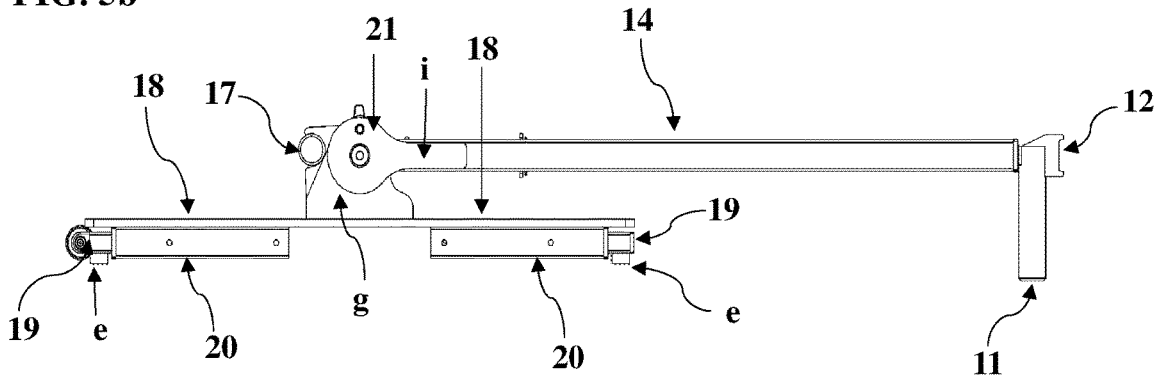
FIG. 5*b* depicts a horizontal side view of the frame 10 in the folded position for storage.

From FIGS. 5*a* and 5*b*, each post 14*a*, 14*b* pivots downward by 90° onto the base's 18 upper surface for easy storage. When folded downward, the dip handles 11*a*, 11*b* are used to lift the frame 10 up at a 45° tilt onto the wheeled stabilizers 19*a*, 19*b*, which allows the frame 10 to roll around for easy transport and storage, like a wheel barrel. In addition, there is a handle 22 cut into the base 18, which can also be used for upward tilting of the folded frame 10. Please note that these words are not a limitation on the scope of the present invention but are shared to illustrate certain embodiments thereof.

Definitions

The terms "Body Coach" or "frame" generally refer to the exercise frame of the current invention. As disclosed above, it includes a base with both wheeled and un-wheeled stabilizers, two pivoting posts, and extending slats having dip handles and magnetic pullup bar holders. The slats are telescopically housed in pivoting posts and may extend the pullup bar upward at heights up to 7.0'. Each post pivots downward by 90° onto the base's upper surface for easy storage. There are other elements to the invention as disclosed below.

The terms "A/R band" or "the band" generally refer to an assistance or resistance band being a sheet or loop of an elastic material made from natural or synthetic latex rubber. These bands are commercially available, and their elasticity and durability have made them popular for rehab and strength training of the legs, triceps, chest, back, shoulders, and the like. Here, I use a band that can support at least 300 lbs of weight at a space between the two posts. However, the band may be exchanged for others that may hold a lesser weight while providing a decreased resistance.

The terms "telescopically" or "telescopic" generally refer to the ability of the extending slats and stabilizers to slide and interlock one within the other of each pivoting post and supports respectively, meaning each tube can be extended or shortened accordingly.

The term "bushing" generally refers to an element, being an interface between two surfaces, that reduces friction and wear at the connecting surfaces. Here, I use a quick release pin that is housed in a square casing that telescopically interacts with the inner cavities of a similar sized tube and a sleeved bearing with a flange, which are commercially available through companies such as iGus, located in East Providence, R.I., providing a smoother movement about the rotation bolt when pivoting the posts into a folded position.

The symbol " generally refers to the linear unit of inches, e.g. 24.00" means 24.00 inches.

The symbol ' generally refers to the linear unit of feet, e.g. 7.00' means 7.00 ft.

The Base

The frame 10 is an assembly of various metal and plastic parts that are either welded together, or secured through friction, magnets, or detent or quick release connectors. The frame 10 may be made from materials including but not limited to stainless steel, copper, iron, titanium, aluminum, nickel, or alloys thereof, rigid polymers, nylon parts, or wood, so long as the material has a hardness and fatigue strength for ease of manufacturing via casting, welding, or machining as balanced by the strength and rigidity needed to support at least 300 lbs at the slats 13*a*, 13*b*, posts 14*a*, 14*b*, and the clevis joints 21.

I will begin at the base 18 and work my way up. All measurements are non-limiting and are meant to show certain embodiments thereof. The base 18 is a square or rectangular metal sheet with slightly rounded corners and measures roughly from about 3.00" to about 6.00" in thickness, from about 24.00" to about 30.00" in width, and about 30.00" to about 45.00" in length. FIG. 1 shows the Body Coach 10 in a fully extended perspective for the pullup bar 17 at a height of 7.00' from the base's 17 top surface. The base 18 rests on four supports, where only 20*b* and 20*c* are shown. All supports 20*a*-20*d* are square metal tubes having hollow innards and circular holes that extend to the outer surface of each tube to act as a stop for detent or quick release connectors used when extending the stabilizers (not shown). Alternatively, FIG. 1*a* shows a full view of the Body Coach 10 where the base 18 does not include wheeled or un-wheeled stabilizers or supports. In this embodiment, the base's 18 bottom surface rests directly on a floor. All other elements are the same as in FIG. 1.

Figure 2:
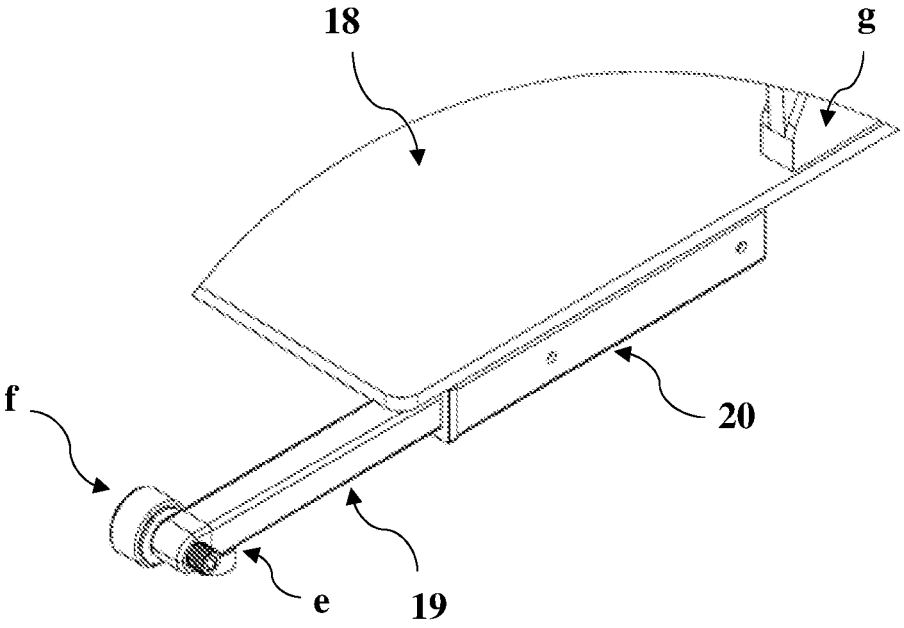
FIG. 2 depicts an enhanced view of the base 18, a support 20, an extending stabilizer 19 having a wheel f, a rubber foot e attached to the bottom of the stabilizer 19, and a portion of the clevis bracket g.

FIG. 2 depicts an enhanced view of the base 18, a support 20, an extending stabilizer 19 having a wheel f, a rubber foot e attached to the bottom of the stabilizer 19, and a portion of the clevis bracket g. Each support 20 is individually connected at a corner of the base's 18 bottom surface. All stabilizers 19*a*-19*d* may be a solid or hollow square metal tube having a detent flange at its end to allow a 6.00" extension of each stabilizer 19*a*-19*d* telescopically housed within the cavity of each support 20*a*-20*d*.

From FIG. 1 and FIG. 2, each front stabilizer 19*a*-19*b* has a wheel f attached to its extended end by having a protruding thread that enters a bore located through an outer portion of a front stabilizer 19*a*-19*b* and secured by a bolt. To prevent sliding across a floor, all stabilizers 19*a*-19*b* include a rubber foot e attached their bottoms. Also note that, a long oval 22, or any uniformed shape for easy handling, is cut into the base 18 to act as an extra handle to raise and tilt the frame 10 when in the folded position for transport and storage.

The Clevis Hinge and Posts

Continuing our way up the frame 10, we are now at the clevis hinges 21 and posts 14. In my description, I will skip about the images, but the conversation will be logical to instruct one of ordinary skill in the making and enjoying the frame 10. FIG. 6*a*, FIG. 6*b*, and FIG. 6*c* are enhanced views of the clevis hinge 21 as seen from the space between the two posts 14 (FIG. 6*a*, FIG. 6*b*) or as seen from the outer side of a post 14 (FIG. 6*c*). The clevis joint 21 is affixed to the base 18 and is an assembly including a clevis bracket g, a rotation bolt 1 and locking nut k, posts 14 having a custom yoke i, flanged bushings with bearings (not shown), and a Kwik-Lock™ pin j.

Figure 8:
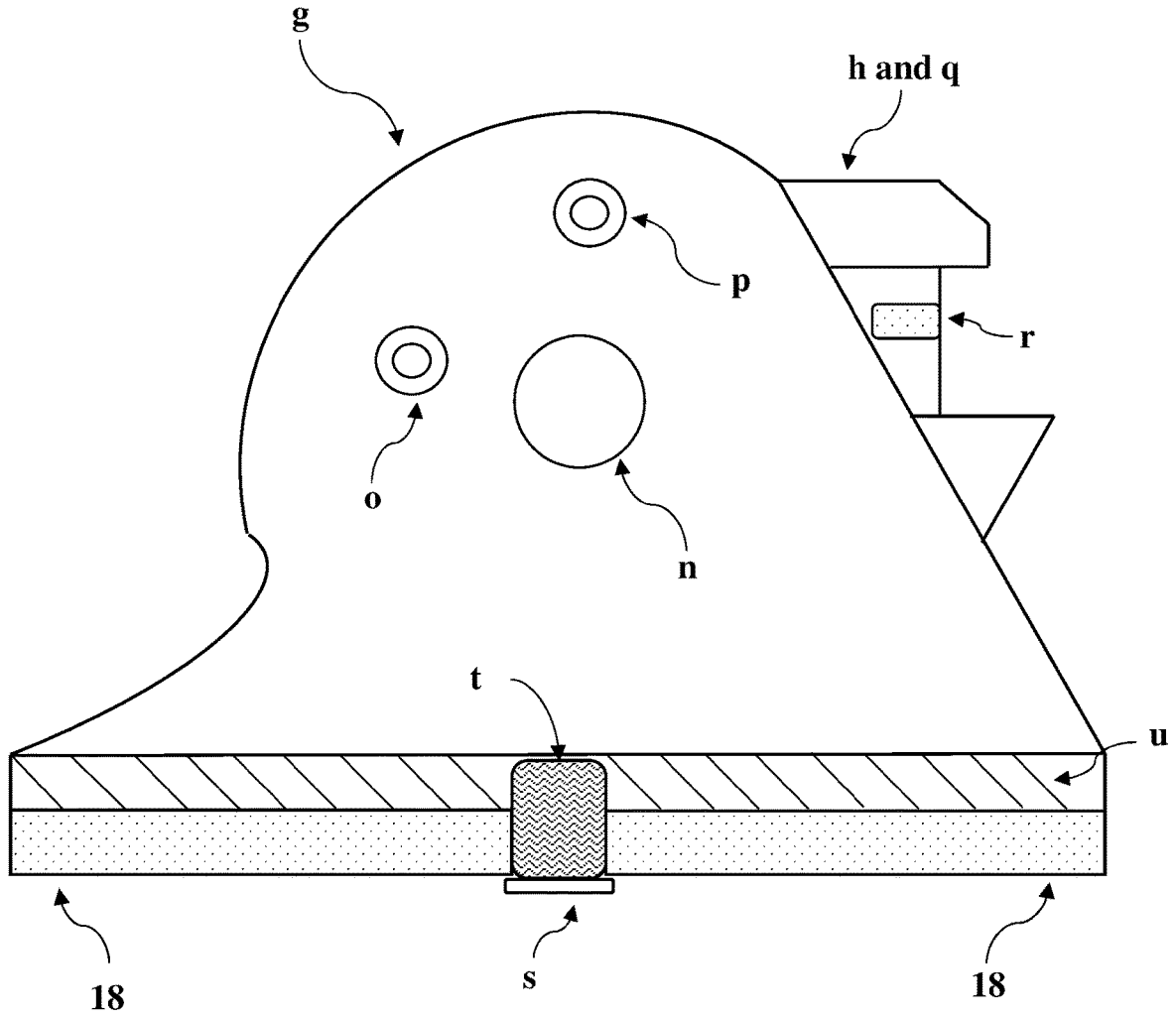
FIG. 8 is a cross section of the clevis bracket g. The bracket g is a lug element used for structural support and as a point of contact for a rotation bolt (not shown). The lug's bottom surface u is fastened to the upper surface of the base 18 by a screw s that aligns with a threaded bore t cut into the base u of the lug. The clevis bracket has three upper bores, a bore for upright positioning of the posts o, a bore for storage positioning of the posts p, and a more centered bore n to accept the rotation bolt and flanged bushings. The positioning bores n, o slidably accepts Kwik-Lok™ pins to lock either post in a desired position. Each clevis bracket g is associated with a sit up position holder u having a magnet r at its center.

FIG. 8 is a cross section of the bracket g, which generally takes the form of a solid metal piece having a top portion that is similar in design to a lifting lug or a standard pad eye for shackles used for mounting or hoisting in an industrial environment. There are many computer programs that may design the specs for the lug, which are not given here, so long as it is designed to mate with the custom yoke i and provides structural integrity when weight is placed upon the same.

As mentioned, the lug acts as a male mate for the custom yoke i. The eye is a centered bore n sized to accept a rotation bolt 1. Angular parts of the lug are associated with a sit up position bar holder q having a magnet r at its center. The bracket's g bottom surface u has a threaded bore t that accepts a screw s to fasten the bracket g to the upper surface of the base 18. The screw s passes through a hole cut in the base 18, which is aligned with a threaded bore t located within the bracket's g bottom surface u. The screw s is then tightened into the threaded bore t to secure the clevis bracket g to the base's 18 upper surface.

Figure 3:
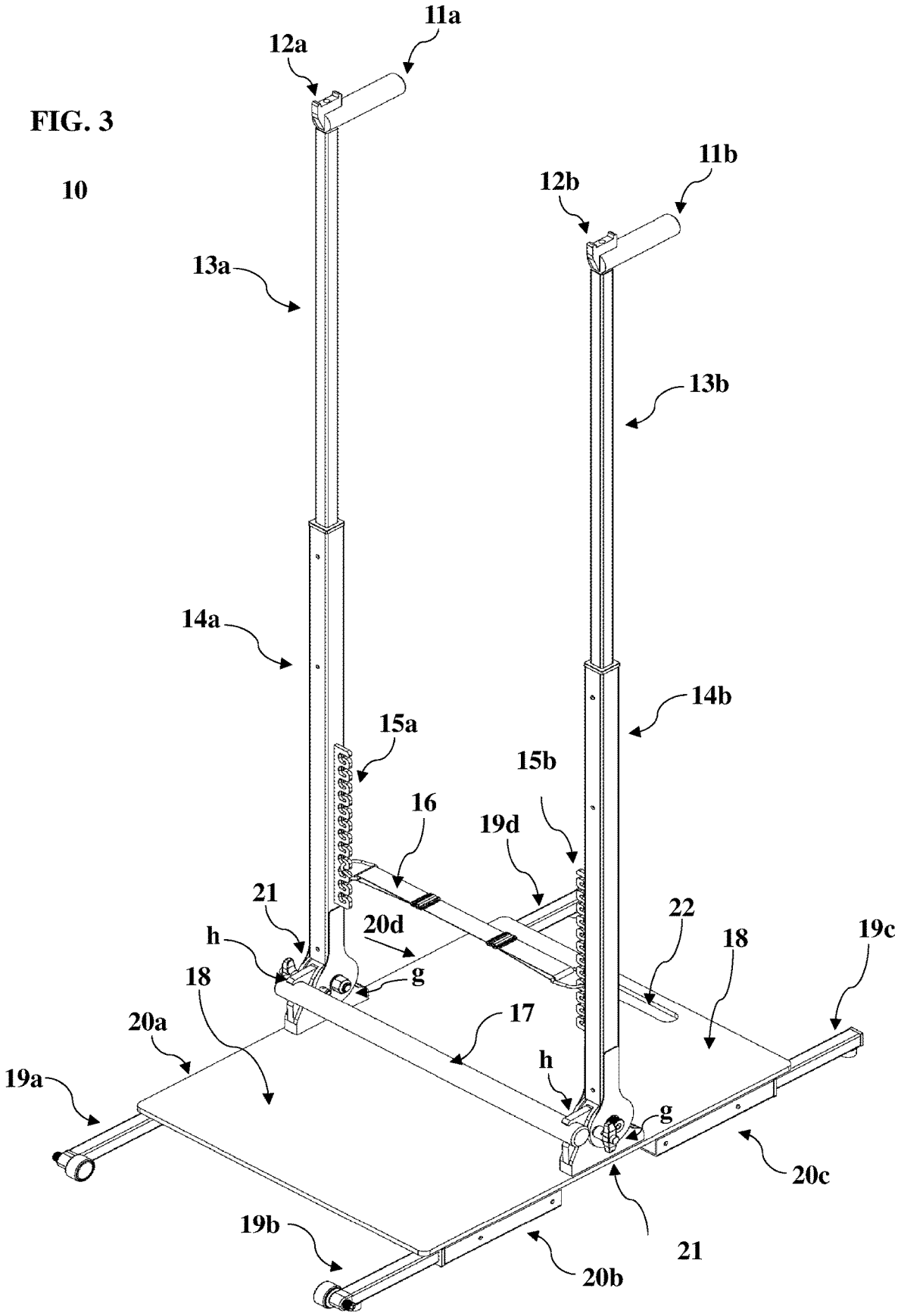
FIG. 3 depicts a full view of the Body Coach 10 in a sit up position. Each slat 13 is extended at their full of height 7.00' for performing more advanced dips at each handle 11*a*, 11*b*. However, the slats 13 can easily lower telescopically into each post 14 for less strenuous dips at heights of 5.50' and 6.00', where a user is aided by the A/R band 16 at any of the extended heights. The pullup bar 17 is held in a space just above the base's 18 upper surface by sit up position holders h, which are like purlin or wide mouthed clamps, less the clamping means, and are associated with each clevis bracket g. Although not shown, each sit up position holder h has a magnet that is aligned to attract another magnet located at the center of a notch cut near the distal ends of the weighted pullup bar 17.
Figure 4:
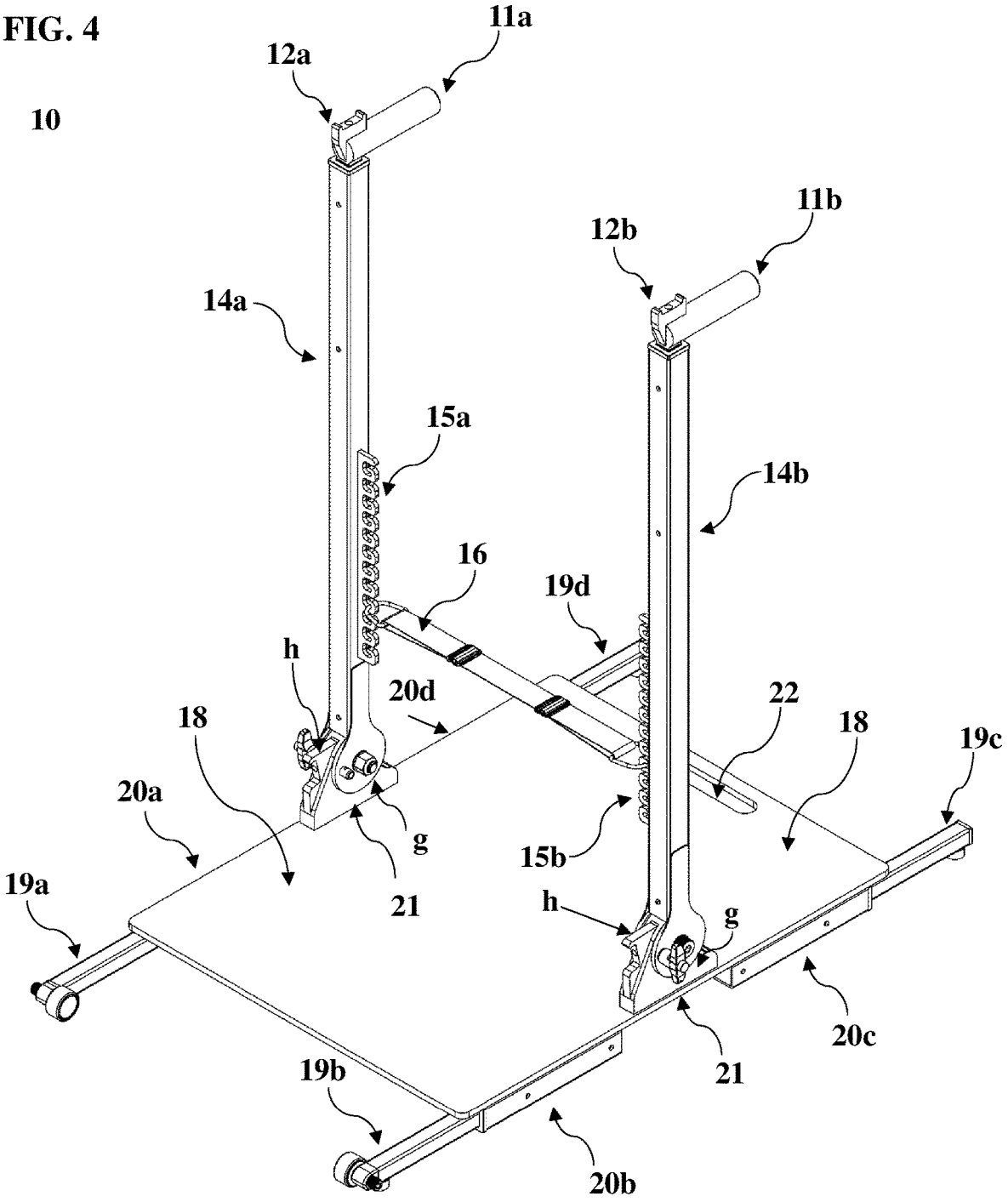
FIG. 4 depicts a full view of the Body Coach 10 in a lowered dip position. Each slat 13 is fully retracted into each post 14 at a lowered height for less strenuous dips, where a user is aided by the A/R band 16. In this image, the pullup bar 17 has been removed and is not shown.

The clevis bracket g has three upper bores, a bore o for upright positioning of the posts, as seen in FIG. 1, FIG. 3, and FIG. 4, a bore p for storage positioning of the posts, as seen in FIG. 5*a* and FIG. 5*b*, and a more centered bore n to accept the rotation bolt 1 and flanged bushings. FIG. 5*b* shows a side view of the frame 10 in a folded position. Each positioning bore o, p slidably accepts Kwik-Lok™ pins j to lock either post in the desired position. Note that, Kwik-Lok™ pins j may be purchased from Jergens Inc. located in Cleveland, Ohio.

The posts 14 are square tubes, preferable made of metal, where the outer surfaces about one distal end are welded with a pair of custom ears to form a yoke i that mates with the lug. From FIG. 6*a*, each ear is a flat metal construct that is a circle leading up to a rectangular shape that matches the planar surfaces of the post 14 to which it is welded. The ear's round portion has a center hole that matches the diameter of the centered bore n located on the lug. Each ear also has an off-center hole to match with either position bore n, o. When a post 14 is lowered onto the bracket g, such that the ears cover the lug, the connection is steadied by the insertion of a rotation bolt 1 into the centered bore n. This forms the hinge. A Kwik-Lok™ pin j is then inserted into bore o for upright positioning for either post 14, or, alternatively, the other bore p for storage positioning of each post 14.

Figure 10:
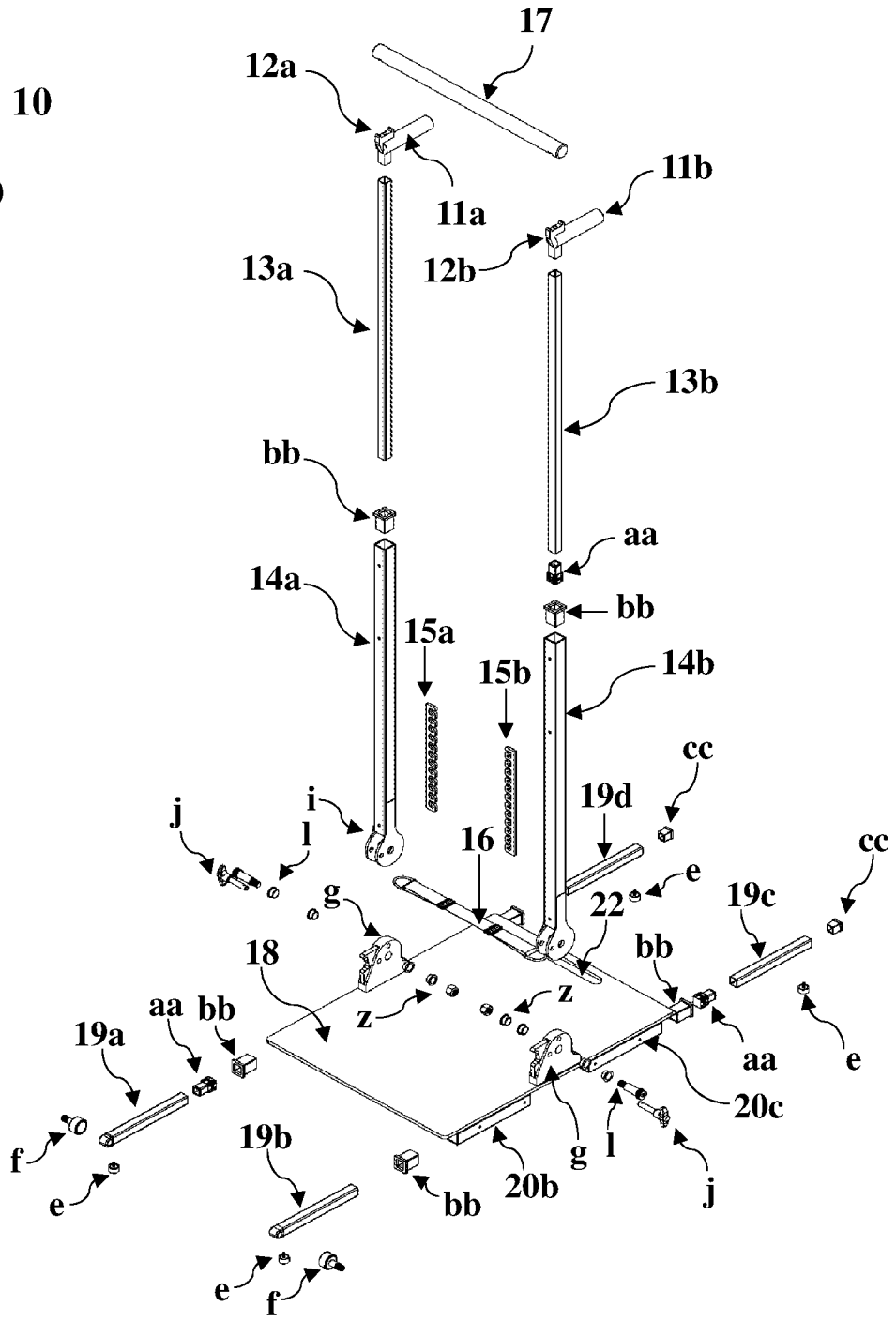
FIG. 10 depicts an exploded image of the frame 10.

FIG. 10 is an exploded view of the frame 10 that shows flanged bushing z about the rotation bolt 1 to give a smoother motion for each post 14*a*, 14*b*. FIG. 5*a* and FIG. 5*b* show how the hinges 21 allow both posts 14 to pivot downward by 90° onto the base's 18 upper surface.

The Weighted Pullup Bar

A key element of the invention is a weighted pullup bar 17. FIG. 1 shows the pullup bar 17 attached to holders 12*a*, 12*b* at the upper most parts of the fully extended slats 13*a*, 13*b*. FIG. 3, FIG. 5*a*, FIG. 5*b*, FIG. 6*b* and FIG. 6*c* all depict the other attached position for the bar 17 at the sit up bar holders h attached to each clevis bracket g.

The pullup bar 17 is a solid cylindrical rod that measures from about 24.00" to about 30.00" long and weighs from about 5.00 lbs to about 12.00 lbs. FIG. 7*a* shows a top down view of the bar 17, where a notch is cut out near both distal ends, but, for simplicity, only one is shown here. FIG. 7*b* shows a cross section of the bar 17, the notch, and how the magnet m is inserted into a hole that is tapped into the center point of the notch. The magnet m secures the bar 17 when attracted by magnets of opposite poles located at the centers of the pullup bar holders 12*a*, 12*b* and the sit up bar holders h.

I am now simultaneously referring to FIG. 8, FIG. 7*a*, and FIG. 7*b*. The cross section of the clevis bracket g has a sit up position holder q that secures the bar 17 in a space just above the base's upper surfaces. This holder q has a similar shape to a purlin beam clamp, a large mouth clamp, or c-beam clamp, less the pressure screw, with the addition of a hole tapped in its center to house a magnet r. The holder q curves to match the radius of the pull up bar 17 and friction fits with the notches near the distal ends of the bar 17. The magnets m located in the notches of the bar 17 are aligned with the magnets located in the holder q to provide an attraction beyond friction to keep the bar 17 in place. When the bar 17 is held by the sit up position holders q near the upper surfaces of the base, one may slide their feet under the bar while lying on their back and perform traditional sit ups without fear of the weighted bar 17 popping out of the holders q.

The Posts, Telescopic Slats, & the A/R Band

Although the frame mimics heights normal to larger workout stations, it considers a user's size and limited range of motion. The present invention extends to heights of 5.50', 6.00', and 7.00' relative to the upper surfaces of the base. An A/R band located between the two posts may be vertically adjusted relative to the extended heights of each slat. Independent vertical movement of the A/R band gives the user a flexible range of comfort by offloading a portion of their weight when their knees are rested across the same and engaging in pullups, chin-ups, or dips.

The tautness of the band can also be adjusted to provide an extra measure of comfort when using the frame. This means that the user experiences a shortened distance between the heights of the pullup bar when extended relative to the vertical placement of the A/R band between the posts, and this is how the frame assists a user with a limited range of motion in performing calisthenics. A non-limiting example being, when the slats extend the pullup bar to 7.00' (84.00"), a user can workout at that height and experience it as a vertical range from 68.00" to 56.00" due to the assistance of the A/R band. At 6.00' (72.00"), the experience translates to a vertical range from 56.00" to 44.00". At 5.50' (66.00"), the experience translates to a vertical range from 50.00" to about 38.00".

FIG. 10 shows an exploded view of the frame 10. Each post 14*a*, 14*b* is multifunctional, being square tubes, preferable made of metal. We disclosed the outer surfaces of each post 14*a*, 14*b* being welded about one distal end with a pair of custom ears to form a yoke i that mates with a clevis bracket 21. Each post 14*a*, 14*b*, including their connectivity to each clevis bracket 21, extends up from about 42.00" to about 45.00" relative to the base's 18 upper surface and serves as a sheath that telescopically holds the slats 13*a*, 13*b* that are also square tubes of smaller dimensions and are about 42.00" in length.

The posts 14*a*, 14*b* and slats 13*a*, 13*b* are a telescoping assembly. This embodiment is non-limiting, and any other forms of telescopic tubing used to achieve the heights of 5.50', 6.00', and 7.00' are covered by the present invention. The slats 13*a*, 13*b* and the posts 14*a*, 14*b* are square tubes, where each slat has a smaller dimension than the post so it can fit inside the larger tube's inner cavity.

Mated to the end of each slat 13*a*, 13*b* is a quick release connector aa having a square end that friction fits into a distal end of each slat 13*a*, 13*b*. The quick release connector aa is also square and sized to the dimensions of each post's 14*a*, 14*b* inner surfaces to friction fit as a bushing to allow each slat 13*a*, 13*b* upward or downward movement along the inner surfaces for each post 14*a*, 14*b*.

Holes are made in each post 14*a*, 14*b* that extend from their outer surfaces into their inner cavities. They are spaced along the posts 14*a*, 14*b* to ensure that the quick release connector aa selectively aligns with each hole and may insert its pin therethrough to lock each slat 13*a*, 13*b* in positions that correspond to heights of 5.50', 6.00', and 7.00' relative to the base's 18 upper surface. This type of telescoping assembly is like those sold by esto Connectors® or can be custom made via machining of metal tubes and using detent pins known in the arts.

There are flanged end caps bb with hollow centers used as buffers at the spaces between the tops of each post 14*a*, 14*b* and the bottom portion of each slat 13*a*, 13*b*. This assembly is repeated and used for telescoping all stabilizers 19 with the supports 20, where the quick release connector mates with holes about the supports 20 to ensure a 6.00" extension therefrom. Although not shown for simplicity, each end of each support and the top ends of each post may have telescoping assembly that includes a flanged end cap bb and a quick release connector aa.

Figure 9:
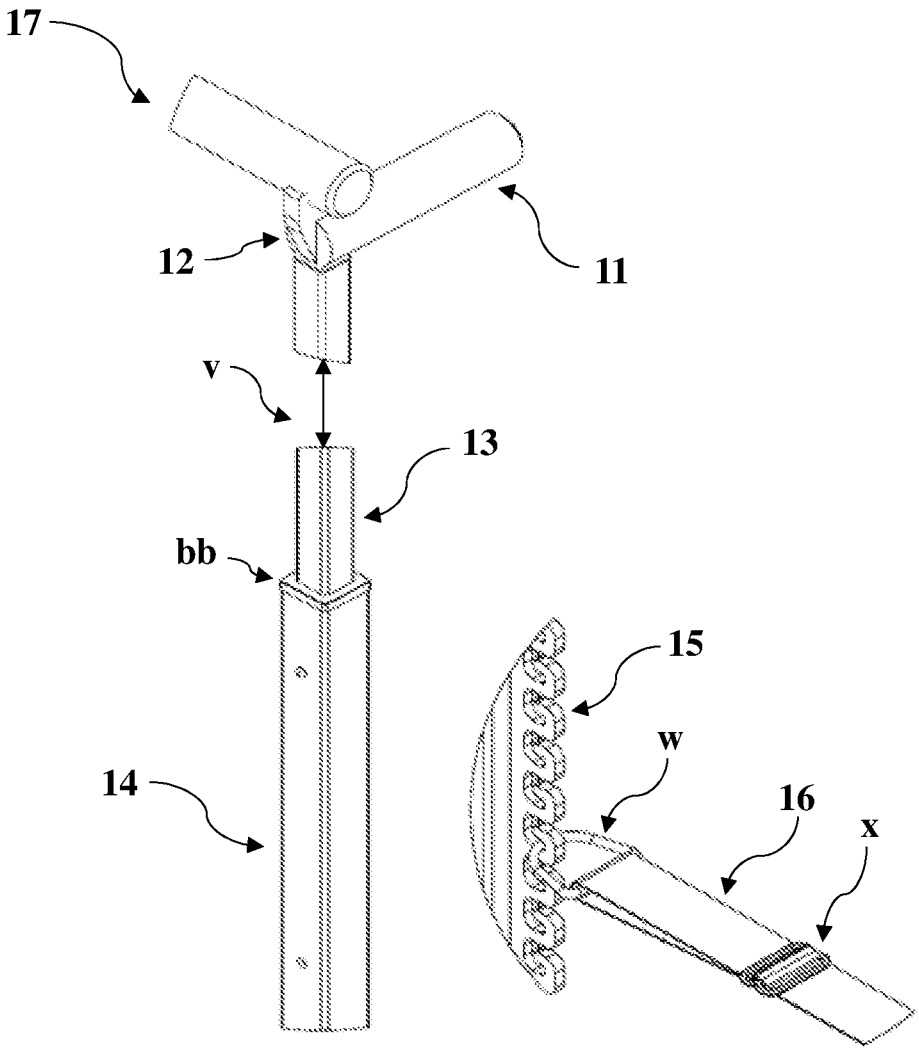
FIG. 9 depicts an extended slat 13 having variable positions v up to 7.00'. The A/R band 16 and retainer hooks 15 are shown as an enhanced view. The A/R band 16 is connected to a post 14 by retainer hooks 15 that catch D-rings w connected to the band 16. A double D-ring buckle x along the band 16 is used to adjust tautness and elasticity of the same 16. The band 16 can be vertically placed at any hook 15 along the retainer with respect to the vertical height of the pullup bar 17 to create a range of comfort for a user irrespective of their physical range of motion.

FIG. 9 shows the extendable portion v of the frame 10, an enhanced view of the A/R band 16 and retainer hooks 15, a dip handle 11, the weighted pullup bar 17, and a pullup bar holder 12. I disclosed the telescopic nature between each slat 13 and post 14, but, for simplicity, the slat 13 vertically extends v up to 7.00' relative to the base's upper surface.

The dip handle 11 is a cylindrical stock or rod where one of its distal ends is welded to a holder 12, like the sit up position holder h detailed in FIG. 8, or the dip handle 11 and holder 12 may be investment cast as a single piece. This holder 12 also has a similar shape to a purlin beam clamp, a large mouth clamp, or c-beam clamp, less the pressure screw, with the addition of a hole tapped in its center to house a magnet (not shown). The holder 12 curves to match the radius of the pull up bar 17 and friction fits with notches near distal ends of the same 17. From FIG. 7*a* and FIG. 7*b*, magnets m located in notches of the bar 17 are aligned with a magnet located in the holder 12 of FIG. 9 (not shown) to provide an attraction beyond friction to keep the bar 17 in place when performing pullups. Also note that, a piece of square tubing is connected to the distal end of the dip handle 11 just under the holder 12 to friction fit with the top portions of the slat 13 to hold the dip handle 11 in place when performing dips or when one engages with the pullup bar 17 for pullups.

As mentioned above, and referring to FIG. 1, an A/R band 16 rests in a space between the two posts 14*a*, 14*b*. Both the band's 16 tautness and its vertical placement within the space, relative to the extended height of the pullup bar 17, are adjustable. The ability to adjust the distance between the height pullup bar 17 and the A/R band 16, in addition to varying the band's 16 tautness, gives a user options when using the frame according to their height and range of motion for assisted pullups, chin-ups, or dips, where the A/R band 16 accepts the weight of a user as an offset at their knees.

Returning to FIG. 9, the A/R band 16 is an assistance or resistance training band being a sheet or loop of an elastic material made from natural or synthetic latex rubber. These bands are commercially available, and their elasticity and durability have made them popular for rehab and strength training of the legs, triceps, chest, back, shoulders, and the like. Here, I use a band 16 that can support at least 300 lbs of weight at a space between the two posts. However, the band 16 may be exchanged for others that may hold a lesser weight while providing a decreased resistance. The band's 16 tautness may be adjusted by double D-rings x located about the length of the band 16, which adjusts the amount of resistance one will experience when their knees are held by the same.

The ends of the band 16 are connected to D-rings w that are secured on retainer hooks 15 located on the outer surfaces of each post 14 that face inward to each other. The retainer hooks 15 are cut from a sheet of rectangular metal as a one piece that matches the surface area of each post 14, where there is a 1.00" space between each retainer hook 15. The finished retainer hooks 15 are welded onto the surface of each post 14 to ensure that the band 16, when connected, rests in a space between the same. The retainer hooks 15 are placed on the posts at a distance of about 16" from the base's upper surface and extends up along the post 14 for another 12.00".

I have detailed my invention, such that one of ordinary skill can make the frame without any undue experimentation. Aspects of a compact and variable exercise frame that adapts to different calisthenics are described above. The frame gives unique relationships between varying placements of a weighted pullup bar and vertical alignments between an adjustable A/R band. The invention is sturdy and mobile and is collapsible for ease storage. It is, of course, not possible to describe every conceivable combination of components or methodologies for purposes of describing these aspects, but one of ordinary skill in the art may recognize that many further combinations are possible. The invention is not limited to any dimensions of the various elements, but the above are non-limiting examples of practical sizes. Accordingly, the aspects described herein are intended to embrace all such alterations, modifications, and variations that fall within the spirit and scope of the following claims.

I claim:

1. An exercise frame comprising:

a. a base with a bottom surface having, four supports, wherein each of the four supports telescopically houses either a wheeled or an un-wheeled stabilizer, and on an upper surface of the base, a handle and two brackets, wherein each of the two brackets is hingedly connected to a respective one of two pivoting posts;

b. wherein each of the two pivoting posts extends a respective retractable slat at heights of 5.50', 6.00', and 7.00' relative to the base's upper surface, and wherein each of the retractable slats has a dip handle and a pullup bar holder connected at an upper most part thereof;

c. wherein each of the two brackets has a respective sit up bar holder located thereon;

d. an assistance or resistance band connected in a space between the two pivoting posts by retaining hooks positioned about each of the two pivoting posts, such that the assistance or resistance band is vertically adjustable at heights from 16.00" to 28.00" relative to the base's upper surface; and e. wherein a weighted pullup bar is configured to be connected to the exercise frame at each of the pullup bar holders or at each of the sit up bar holders.

2. The exercise frame of claim 1, wherein each of the two pivoting posts independently rotates downward through a joint affixed to the upper surface of the base, wherein each of the joints includes the respective one of the two brackets, a rotation bolt, a lock nut, and a locking pin being connected to a custom yoke located at the respective lower end for each of the two pivoting posts.

3. The exercise frame of claim 1, wherein the assistance or resistance band is configured to be vertically placed on the retaining hooks of each of the two pivoting posts and between the two pivoting posts at heights from 16.00" to 32.00" relative to the base's upper surface, wherein the assistance or resistance band is made from a natural or synthetic latex rubber that is configured to support up to 300 lbs with minimal wear to elasticity, and a tautness of the assistance or resistance band is configured to be adjusted by one or more buckles.

4. The exercise frame of claim 1, wherein the base is a square sheet or a rectangular sheet with rounded corners and is 3.00" to 6.00" thick, 24.00" to 30.00" wide, and 30.00" to 45.00" long and is made of nickel, aluminum, stainless steel, copper, iron, titanium, or alloys thereof, rigid polymers, nylon parts, or wood.

5. The exercise frame of claim 1, wherein the weighted pullup bar is weighted from 5.00 lbs to 10.00 lbs and has notches near its distal ends, where the center of each of the notches is tapped and holds a magnet.

6. The exercise frame of claim 1, wherein the pullup bar holder of each of the retractable slats has a magnet at its center.

7. The exercise frame of claim 1, wherein the sit up bar holder of each of the two brackets has a magnet at its center.

* * * * *